US007510463B2

(12) United States Patent
Kim et al.

(10) Patent No.: US 7,510,463 B2
(45) Date of Patent: Mar. 31, 2009

(54) EXTENDED LIFE CONDITIONING DISK

(75) Inventors: Ben Kim, Wappingers Falls, NY (US); Manoj Balachandran, Wappingers Falls, NY (US); James Aloysius Hagan, Hopewell Junction, NY (US); Deoram Persaud, Bronx, NY (US); Adam Daniel Ticknor, Poughquag, NY (US); Wei-tsu Tseng, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/422,753

(22) Filed: Jun. 7, 2006

(65) Prior Publication Data

US 2007/0287367 A1 Dec. 13, 2007

(51) Int. Cl.
*B24B 1/00* (2006.01)
*B24B 21/18* (2006.01)

(52) U.S. Cl. ..... 451/56; 451/443

(58) Field of Classification Search ..... 451/56, 451/443; 125/11.23
See application file for complete search history.

(56) References Cited

U.S. PATENT DOCUMENTS 5,216,843 A * 6/1993 Breivogel et al. ..... 451/285
5,547,417 A * 8/1996 Breivogel et al. ..... 451/58
5,782,682 A * 7/1998 Han et al. ..... 451/548
5,954,570 A * 9/1999 Yano et al. ..... 451/285
6,190,243 B1 * 2/2001 Wada et al. ..... 451/288
6,371,836 B1 * 4/2002 Brown et al. ..... 451/56
6,402,883 B1 * 6/2002 Billett ..... 156/345.12
6,514,127 B2 * 2/2003 Huang et al. ..... 451/72
6,935,938 B1 * 8/2005 Gotkis et al. ..... 451/443
6,949,012 B2 * 9/2005 Barnett, III ..... 451/56
7,033,253 B2 * 4/2006 Dunn ..... 451/56
7,066,795 B2 * 6/2006 Balagani et al. ..... 451/285
7,094,134 B2 * 8/2006 Lujan ..... 451/56
7,097,545 B2 * 8/2006 Lee et al. ..... 451/72
2002/0065029 A1 * 5/2002 Huang et al. ..... 451/72

* cited by examiner

*Primary Examiner*—Maurina Rachuba
(74) *Attorney, Agent, or Firm*—Yuanmin Cai; Howard Cohn

(57) ABSTRACT

The present invention is an apparatus and method for extending the life of abrasive disks used in the conditioning of polishing pads used in chemical mechanical planarization (CMP) of polishing pads used to polish and/or planarize the surfaces of semiconductor wafers during the production of integrated circuits. The invention consists of the a disk comprising a plurality of abrasive segments, each of which is fixed in tangential and radial relationship to one another about the common axis of rotation of the conditioning disk. Means are provided for movement of the abrasive segments, individually or in sets, into or out of the plane of the active abrasive surface of the conditioning disk according to the present invention.

11 Claims, 4 Drawing Sheets

FIGURE 1 (Prior Art Conditioning Disk Arrangement)

EXTENDED LIFE CONDITIONING DISK

FIELD OF INVENTION

The present invention relates to abrasive disks used in the conditioning of pads in chemical mechanical polishing of silicon wafers of the sort used in the production of integrated circuits. More specifically, the present invention relates to an apparatus and method for extending the service life of disks that are used to condition the polishing pads.

BACKGROUND OF THE INVENTION

Integrated circuits (ICs) are typically produced en mass upon single, circular semiconductor wafers having diameters of up to about 30 centimeters (cm).

The semiconductor wafers from which the ICs are cut may have multiple layers of wiring devices on a single wafer. Each layer of circuitry consists of thousands of electrical circuits that will eventually be die cut from the wafer. The successive layers are separated from one another by intervening dielectric layers made of materials such as silicon dioxide. The dielectric and/or metal forming each layers has to be polished or 'planarized' before the next layer of circuitry can be deposited. The polishing (or planarization) process is called CMP, which stands for Chemical Mechanical Planarization.

CMP is superior to previously used planarization technologies because it has proven capable of both local and global planarization of the materials used in the fabrication of multilevel ICs. During CMP, a slurry of fine abrasive particles suspended in liquid chemical solutions react with the surface being polished to achieve the necessary degree of flatness prior to the deposition of the next layer.

A layer of insulating material, commonly silicon dioxide or variations thereof, is used to separate each successive layer of the fabricated circuitry so that each sequentially deposited IC layer will not, unintentionally, interconnect with subsequent layers of circuitry. In order to pack more devices into less space, the requirements for feature size within the ICs has shrunk dramatically. Features that protrude into or across circuitry layers and make contact where not intended, or do not make contact where intended, can cause short circuits or open circuits and other defects that make an otherwise valuable product unusable.

One difficulty with CMP is a reduction in the rate at which the CMP pad, or CMP polishing pad, removes material from the wafer being polished and thus the speed of planarization decreases with use. Most conventional polishing pads are made of various kinds of filled or unfilled thermoplastics such as polyurethane. The polishing surface of the pads tends to become glazed and worn during the polishing of multiple wafers. The pad's surface characteristics change sufficiently to cause the polishing performance to deteriorate.

Deterioration of polishing pad performance is typically reversed by the use of means to 'condition' the pad surface during use, or between polishing steps, as needed.

The pad conditioning procedure uses a conditioning disk that has diamonds or other hard abrasive particles bonded to it. When this disk is applied to the polishing pad it mills away the top surface of the pad exposing fresh asperities and recreating the micro texture in the surface. Conditioning of the pad is also necessary because the surface of the polishing pads undergoes plastic deformation during use, due to pressure and heat.

Pad conditioning provide a consistent pad polishing performance by periodically regenerating the surface of the pad. Some polishing operations use continuous pad conditioning, others intermittent, some between wafers. The conditioning apparatus generally consists of an arm to which is attached a rotating disk to which is attached the abrasive conditioning surface that rotates while it radially traverses the surface of the rotating polishing pad. The conditioning disk generally has fine diamond grit bonded to its active surface.

Like the pad, the conditioning disk also undergoes wear of its abrasive surface, requiring that it be replaced periodically in a process that requires stopping of the CMP processing of wafer and a consequent reduction in productivity. Thus the conditioning of polishing pads places service-life constraints upon the conditioning disk. A way to increase the operational of the service life of the conditioning disk is thus a desirable goal.

It is worth noting that the rotating conditioning disk also radially traverses the polishing pad while renewing the pad surface and restoring polishing pad performance.

When the conditioning disks are new, the diamond particles are very sharp and quickly 'roughen' up the polishing pads. Over time, however, the conditioning effectiveness of the disks decreases until it has to be replaced.

SUMMARY OF THE INVENTION

According to the present invention, a circular abrasive conditioning disk having a rotational center comprises a plurality of abrasive portions that are independently movable in relation to an active abrasive conditioning surface of a CMP pad. The plurality of abrasive portions are independently movable in a direction that is approximately normal to the plane that defines said active abrasive conditioning surface. The plurality of congruent abrasive portions are arranged in relation to one another in such as way as to comprise a radially symmetrical pattern about the rotational center of the conditioning disk, and at least three of the plurality of independently movable abrasive portions are able to move more or less simultaneously into the plane that defines the active abrasive conditioning surface, and in such as way as to be radially symmetrical about the rotational center of the circular abrasive conditioning disk.

Also according to the present invention, vertical movement means are provided for precise movement of at least three of the plurality of independently movable abrasive portions into or out of the plane that defines the active abrasive conditioning surface.

Still further according to the present invention, each congruent abrasive portion of the plurality of congruent abrasive portions is wedge shaped and has a vertex that is oriented approximately toward the rotational center of circular abrasive conditioning disk, said congruency deriving from each of the plurality of wedge shaped abrasive portions having a similar shape and substantially equal characteristic dimensions to the other wedge shaped abrasive portions.

Yet further according to the present invention, the abrasive segments can also be circular in shape and have diameters that are equal to that of the other circular abrasive portions.

Still further according to the present invention, each abrasive portion of the plurality of abrasive portions can be other than wedge shaped or circular, so as to be noncircular in shape, but mutually similar in shape and having the same characteristic dimensions as each of the other of the plurality of abrasive portions. Each of the noncircular abrasive portions is disposed in relation to the other noncircular abrasive portions in such a way as to comprise a radially symmetrical pattern about the rotational center of the circular abrasive conditioning disk. At least three of the plurality of independently movable noncircular abrasive portions are able to move more or less simultaneously into the plane that defines the active abrasive conditioning surface, and they are able to move more or less simultaneously into the plane that defines the active abrasive conditioning surface and are disposed in relation to one another in such as way as to be radially symmetrical about the rotational center of the circular abrasive conditioning disk.

Also, according to the invention, a circular abrasive conditioning disk has a rotational center and comprises a plurality of concentrically arranged and circular abrasive portions that are independently movable in relation to a plane that defines an active abrasive conditioning surface of a CMP pad. Each of the plurality of concentric and circular abrasive portions is independently movable in a direction that is more or less normal to the plane that defines said active abrasive conditioning surface of the CMP pad.

Further according to the present invention, the means are provided for precise movement of at least one of the plurality of independently movable concentric abrasive portions into or out of the plane that defines the active abrasive conditioning surface of a CMP pad.

According to the present invention, a method is disclosed by which to extend the operational service life of a circular abrasive conditioning disk. The method comprises the steps of arranging a plurality of independently movable congruent abrasive portions about a common center of rotation having an axis of rotation, and fixing the plurality of independently movable congruent portions having abrasive surfaces in a circular pattern such that the abrasive surfaces of the abrasive portions are in a plane that is perpendicular to the axis of rotation.

Further according to the present invention, the method also consists of constraining each congruent abrasive portion from radial or tangential motion with respect to the common center of rotation and with respect to one another. Also, means are provided for precise movement of one or more of the independently movable congruent portions into or out of said same plane that is perpendicular to said axis of rotation.

DEFINITION

The word 'circular' refers hereinbelow to the overall shape of the proposed conditioning disk according to the present invention and is to be construed in such a way, as should be readily apparent to those who are skilled in the art, as to include regular polygonal shapes having n sides wherein n is some number greater than two.

BRIEF SUMMARY OF THE DRAWINGS

The structure, operation, and advantages of the present invention will become further apparent upon consideration of the following description taken in conjunction with the accompanying figures (Figs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
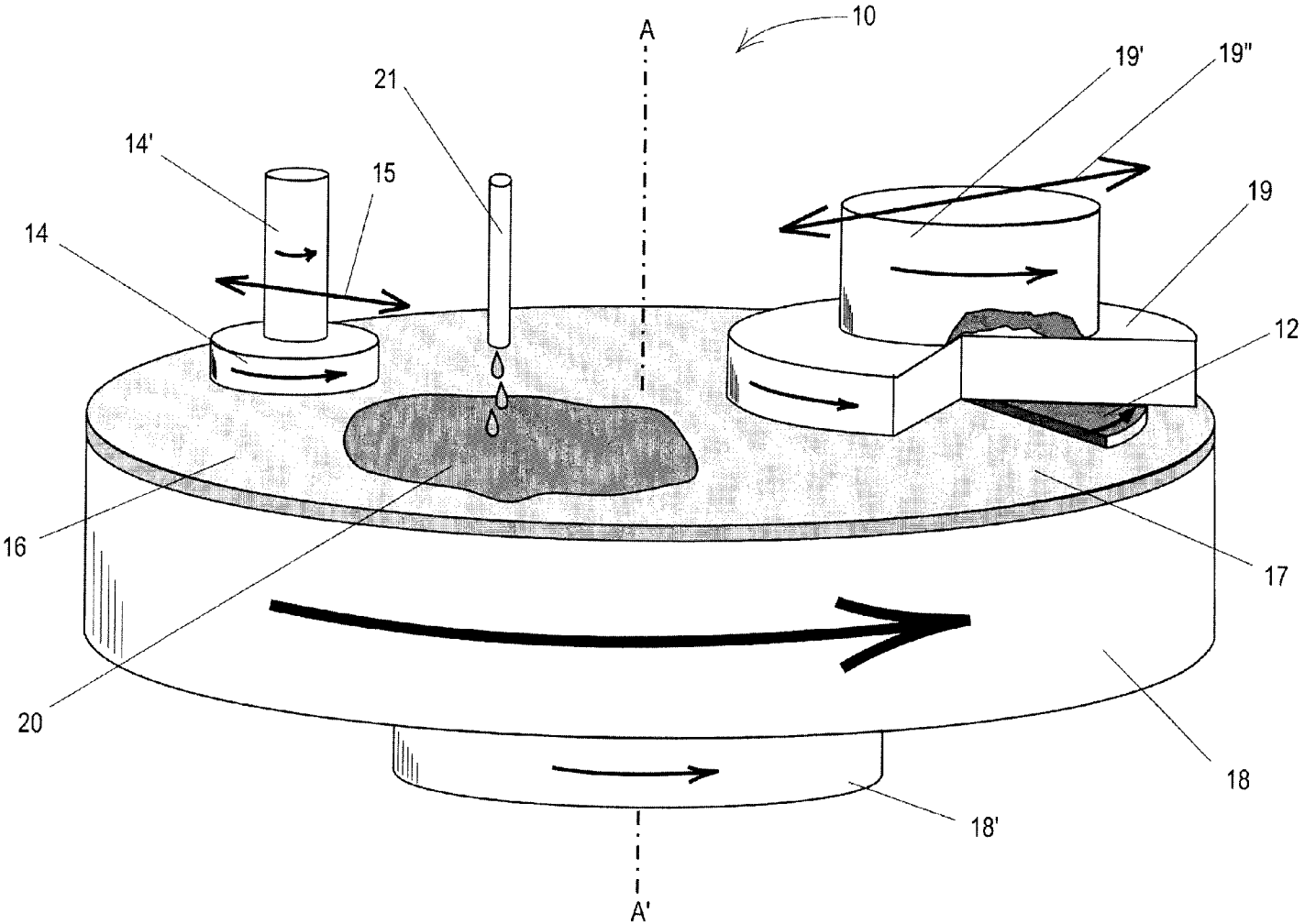

In the drawings accompanying the description that follows, often both reference numerals and legends (labels, text descriptions) may be used to identify elements. If legends are provided, they are intended merely as an aid to the reader, and should not in any way be interpreted as limiting.

FIG. 1 is an oblique schematic view of the prior art CMP system.

Figure 2:
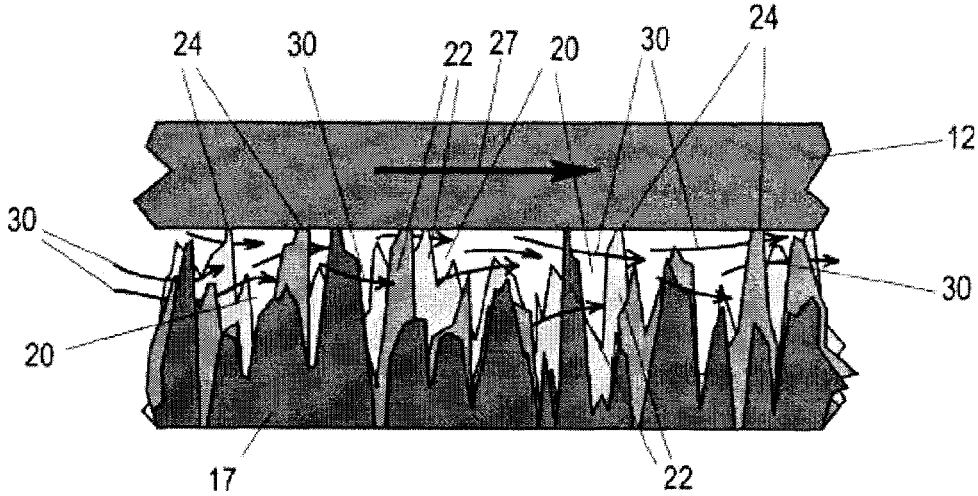

FIG. 2 is an edge-on schematic view of a wafer in contact with a polishing pad that is being conditioned.

Figure 3A:
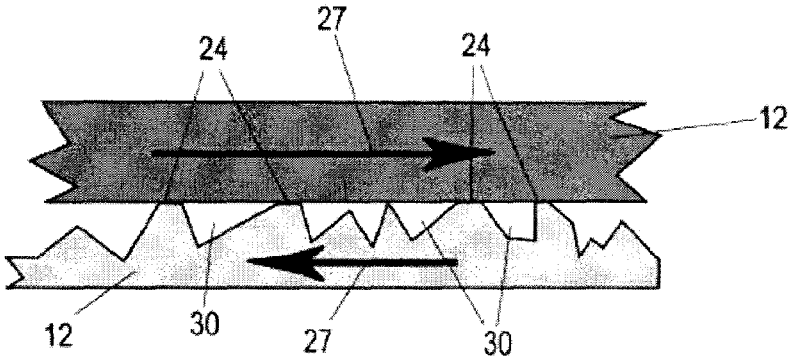

FIG. 3A is an edge-on schematic view of wafer in contact with a polishing pad that is being conditioned, prior to wear away of the asperities.

Figure 3B:
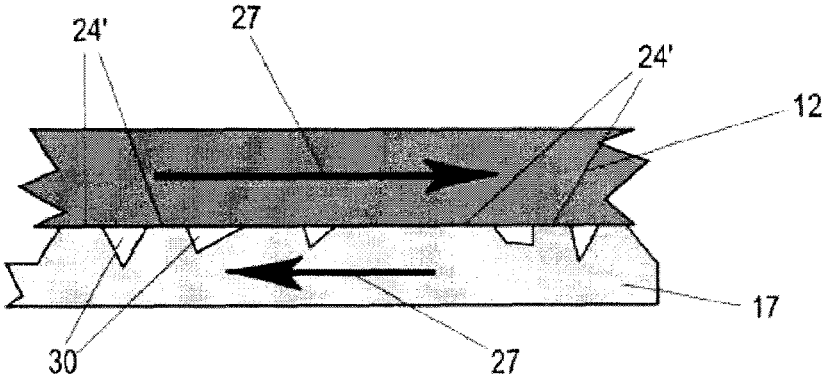

FIG. 3B is an edge-on schematic view of wafer in contact with a polishing pad that is being conditioned, subsequent to wear away of the asperities.

Figure 4A:
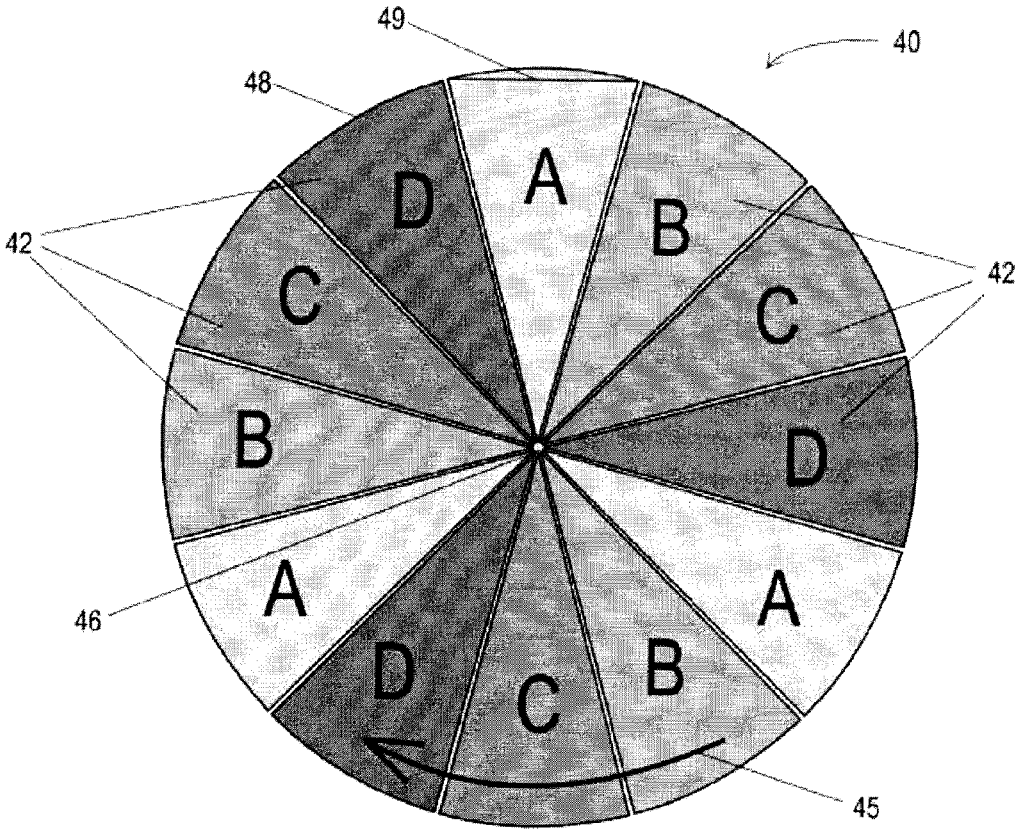

FIG. 4A is an orthogonal view of the abrasive surface a first embodiment of the present segmented conditioning disk.

Figure 4B:
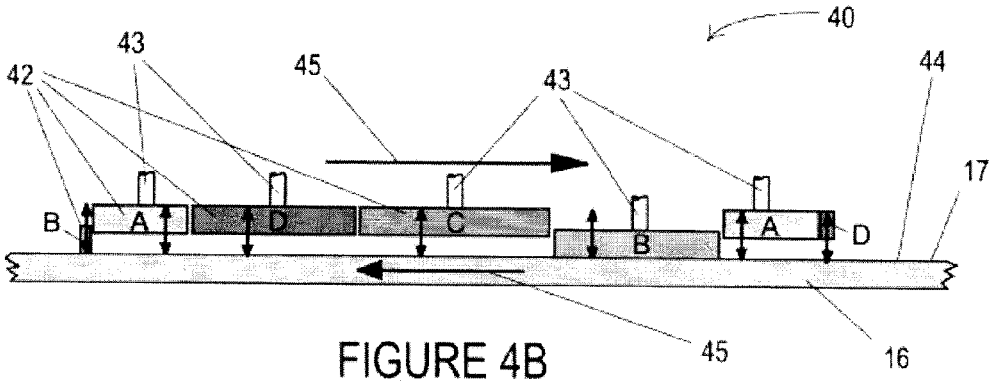

FIG. 4B is an edge-on schematic view of the abrasive surface the first embodiment of the present segmented conditioning disk.

Figure 5A:
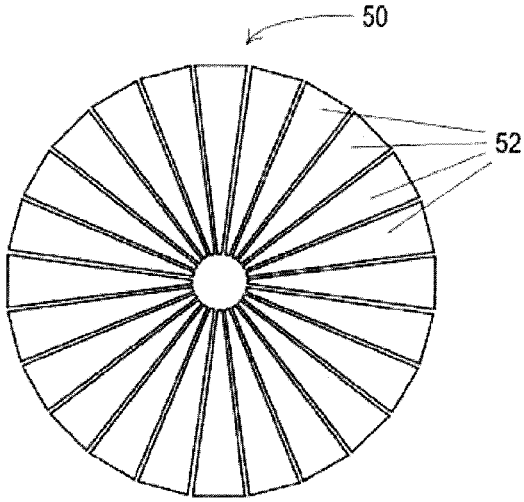

FIG. 5A is a generalized, polygonal embodiment of the present segmented conditioning disk invention.

Figure 5B:
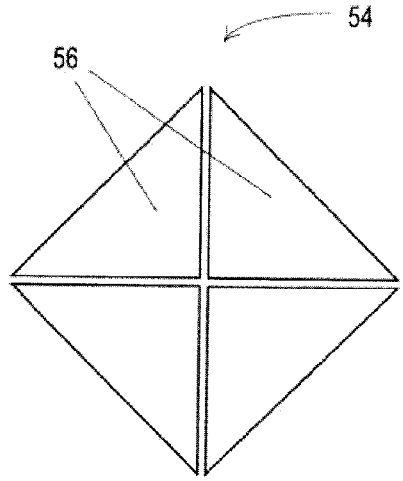

FIG. 5B is a four-sided embodiment of the present segmented conditioning disk invention.

Figure 6:
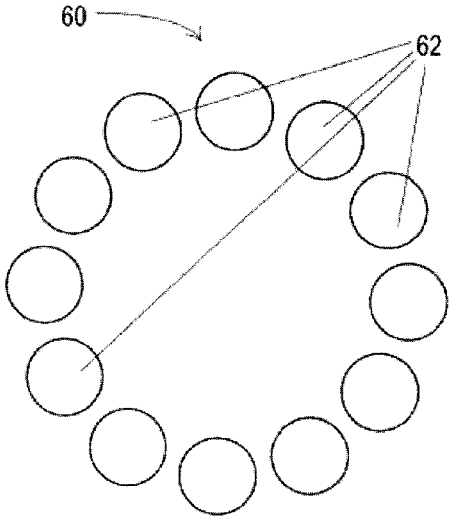

FIG. 6 is an embodiment of the present invention in which the segments are circular.

Figure 7:
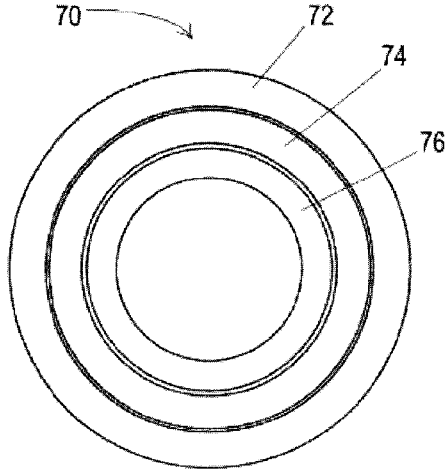

FIG. 7 is an embodiment of the present invention wherein the independently movable portions are concentric with one another.

DETAILED DESCRIPTION OF THE PREFERRED EMBODIMENTS

Prior Art and State of the Art System

FIG. 1 is an oblique schematic, partially cut-away, view of a polishing system 10 for polishing/planarizing the surface of a semiconductor wafer 12, showing a prior art conditioning disk 14 that is rotationally driven by shaft 14' which can move radially, according to the double-headed arrow 15, with respect to the center of the polishing pad 16 which is affixed to the rotating platen 18 that is driven by the shaft 18' about the axis A-A'. More specifically, the wafer 12 is rotated against the rotating polishing pad 16 (which has a top-most surface 17) by means of the rotating head 18, which is driven by shaft 18'. The head 18 can also move radially with respect to the rotating polishing pad, as indicated by the double-headed arrow 19.

Referring the FIG. 2, which is an orthogonal, edge-on schematic edge view of the top-most portion 17 of the polishing pad 16 and the moving wafer 12, said top-most portion 17 has numerous independent pores 20 that contain a continually refreshed slurry 30 (i.e., indicated by flow arrows 30) consisting of fine abrasive material carried in a liquid mixture that might or might not be chemically reactive with the wafer 12 being polished. The slurry 30 is fed to the polishing surface 16 by means of the supply pipe 21, as shown in FIG. 1.

The pores 20 can be characterized as microscratches that are close enough together to form wall structures 22, portions of which are micro asperities that protrude far enough upward to make intimate contact with the wafer 12. Arrows 27, as shown in FIGS. 3A and 3B, indicate relative motions of the pad surface 17 and the wafer 12. The micro asperities 22 provide contact regions 24, whereat the slurry 30 reacts with and polishes the surface of the wafer 12. One can think of the slurry 30 as an abrasive lubricant that moves between wafer 12 and each asperity peak 24 so as to, in effect, pressurize the abrasive slurry against the wafer surface being polished or planarized. The asperity peaks 24 deform somewhat during abrasively lubricated contact with the wafer 12.

FIGS. 3A and 3B are schematic edge-on views of the wafer 12 in contact with the top-most surface 17 of the polishing pad 16, illustrating the effects upon the surface 17 and the asperity peaks 24 and 24' as the polishing process takes place. That is to say, the asperity peaks 24 become worn down to the condition 24', with the deleterious effect upon the polishing process being accordingly degraded by the increased surface areas of the worn peaks 24', which corresponds to reduced pressure between the asperity peaks 24' and the wafer 12. Deterioration occurs continuously during the polishing/planarizing process. The real contact area increases over time as the asperities make direct push the abrasive slurry 30 against the wafer 12, the effect being a reduction in the real contact pressure, which causes the material removal rate (from the wafer) to decrease. To achieve constant removal rate and uniformity, it is required to maintain a more or less constant contact area and effective pressure of the slurry 30 against the surface of the wafer 12 being polished. Accordingly, the function of the diamond abrasive conditioning disk 14 (FIG. 1) is to regenerate the sharp-pointed asperities 22 (FIG. 2) on the top-most surface 17 of the polishing pad 16.

As material is being removed from the wafer 12 by means of the polishing pad 16 and slurry 30 (in FIG. 2), debris also gets deposited into the voids 30 of the top part 17 of the polishing pad 16. In order to have a consistent pad surface each time a wafer is pressed on the pad, the diamond abrasive conditioner disk 14 (FIG. 1) resurfaces, or conditions or reconditions, the pad 16. The conditioner 14 is typically a plate with diamonds bonded to it creating an abrasive surface (not shown). However, with repeated use, even diamonds become dull and lose their cutting and conditioning effectiveness. Thus it is the case that the conditioning disk 14 has to be replaced periodically in a process that requires stopping the CMP process and a consequent reduction in manufacturing productivity.

First Embodiment of the Invention

Whereas the prior art conditioning disk 14 has a single contiguous abrasive surface, the present invention envisions a segmented condition disk 40, as shown schematically in FIGS. 4A and 4B. The conditioning disk 40 is but one embodiment of the present invention. (Arrows 45 indicate rotary motion and relative motion respectively in FIGS. 4A and 4B.)

FIG. 4A shows the conditioning disk 40 as comprising congruent pie-shaped segments 42, of which the exemplary set of twelve segments shown comprise four subsets labeled A, B, C, and D, each of which comprises three segments. The segments 42 are arranged about a common center or axis of rotation 46 in a plane that is perpendicular to said axis of rotation. Each movable and congruent segment 42 is from radial or tangential motion with respect to said axis of rotation, or shared or common center of rotation, and with respect to one another.

The inventors also envision more or fewer segments 42, as will be discussed in more detail below. Each of the twelve segments 42 of FIG. 4A are independently movable in a vertical direction, as indicated in the schematic edge-on side view of FIG. 4B; more specifically, they the inventors envision, in this example of 12 segments, that a radially symmetrical set of any three of them, such as, for example, all segments labeled 'B', might be lowered, as shown in FIG. 4B, to engage the surface 44 of pad 16 that is being abraded during the conditioning process. The remaining segments, i.e., A, C and D in FIG. 4B are disposed above the plane of 44, in a kind of storage position in which they are held in anticipation of future use or when the three segments A have been expended or worn out subsequent to conditioning use.

The inventors envision that the conditioning disk 40 of FIG. 4A might be mounted upon a swiveling drive shaft (not shown) that will automatically adjust the angle of contact of the segments 42 with the plain of abrasion 44 of surface 17 in such a way as to maintain uniform conditioning pressure and action upon the surface 17, even if the set of segments 42 that are in abrading contact with the surface 17 are not necessarily radially disposed with respect to the rotational center 46 of the disk 40. That is to say, the inventors envision that the segmented conditioning disk 40, according to the present invention, can be used in such a way that, say, for example, two of segments 42 labeled 'A' might be used in conjunction with two or three segments 'D' and/or 'B'.

The inventors further envision a means 43 for the raising and lowering of individual segments or sets of segments 42, said raising-and-lowering means consisting of such actuators as solenoids, pneumatic or hydraulic pistons, screw drives or the like.

More generally, the conditioning disk 40 according to the present invention comprises multiple sections/zones 42, such that specific zones can be activated independently, i.e., moved vertically into or out of contact with the plain of abrasion 44, which is coincident with the top-most surface 17 of the polishing pad 16. The schematic side view of FIG. 4B shows three segments 42, each labeled 'B', making contact with the plain of abrasion 44 upon the top-most surface 17 of the CMP pad 16. That is to say, the three segments 42 are independently movable in relation to an active abrasive conditioning surface 17 of a CMP pad 16.

As should be evident to those skilled in the art upon contemplation of FIG. 4A, the segmented conditioning disk 40 according to the present invention can comprise, in general, of n number of segments 42, where n is greater than at least three. Moreover, those skilled in the art might reasonably surmise that the rounded portion 48 of each segment 42 could as well be a chord 49, such that said disk 40 would more accurately be describable as having a regular polygonal shape, rather than an overall circular, shape. Hence, the specific definition given above for the adjective 'circular' as referring herein to regular polygonal shapes, even though irregular polygonal shapes might also be contemplated by those skilled in the art.

Thus it is that the object of this invention is concerned with extending the service life and operational consistency of polishing-pad conditioner disks. In its simplest embodiment the individual controlled multiple segment disk 40 (FIG. 4A) allows users to move one or more fresh conditioner surfaces into action by activating fresh segments and deactivating spent segments without having to stop the CMP process. An embodiment that offers further control would continue to use the segments as they wear but activate just enough fresh material from unused segments to compensate for the worn segments. In its most refined form, the present invention allows modulation not only of the number of segments in use at any given time but also the pressure applied to each in order to maintain a far more consistent cut rate of the polishing pad then the prior art conditioner disk can generate. As describe hereinabove, the raising-and-lowering means allows various segments or abrasive zones of the invention to be selectively brought into contact with the polishing pad 16 when needed to improve consistency of conditioning operation and consistency of the CMP process. As some of the abrasive segments/zones on the conditioner wear, others can be brought into or removed from action, thus maintaining the cut rate of the disk 40 and extending the time between tool downs for servicing of this part 40.

This invention would allow better use of conditioning disks by providing more stable conditioning rate. It is worth mentioning that another alternative is to use several zones or segments 42 to start and then slowly ramp the pressure on one or more other zones to maintain the optimal conditioning rate and desired result.

Additional Embodiments of the Invention

Those skilled in the art might easily imagine additional ways to provide a conditioning disk having the properties described hereinabove. For example, a conditioning disk 50, shown in the schematic view of FIG. 5A, is shown comprising a plurality of independently moveable abrasive segments/zones/portions 52 having a collective shape equivalent to a regular polygon of n portions. FIG. 5B is an example of a disk 54 comprising only four portions 56 which add up to a 'circular' disk in accordance with the specific definition of 'circular' given hereinabove.

FIG. 6 is an embodiment 60 of a conditioning disk comprised of multiple circular portions or segments 62, each of which, either independently or in groups, can be raised or lowered to provide conditioning action of a polishing pad. As should be apparent to those skilled in the art, the segments 62 of the embodiment 60 and which are shown in FIG. 6 as having circular shapes need not be constrained only to circular shapes or to other regular shapes such as triangles or polygons.

FIG. 7 is yet another embodiment of the present invention, wherein a segmented conditioning disk 70 comprises 3 or more or fewer concentric portions/zones 72,74,76 which can be moved into our out of operation independently or in groups. The circular abrasive conditioning disk 70 has vertical movement means (not shown in FIG. 7) that provide for precise movement of at least one of the plurality of independently movable concentric abrasive portions into or out of the plane that defines the active abrasive conditioning surface of a CMP pad.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

The invention claimed is:

1. A method by which to extend the operational service life of a circular abrasive conditioning disk for conditioning an active abrasive conditioning surface of a CMP pad, said method comprising the steps of:

arranging at least three independently movable abrasive segments on a single circular disk about a common center of rotation, each abrasive segment having an abrasive surface of diamond particles;

disposing the at least three independently movable abrasive segments in a storage position spaced from a plane that defines the active abrasive conditioning surface of the CMP pad; and moving one of the at least three independently movable abrasive segments into the plane that defines the active abrasive conditioning surface to start conditioning the surface while keeping the remaining segments disposed in the storage position for use after the one of the at least three independently movable abrasive portions has been worn out subsequent to conditioning the surface of the CMP pad.

2. The method of claim 1 further including the steps of:

moving the one of the at least three independently movable abrasive segments from the plane, that defines the active abrasive conditioning surface, back to the storage position; and moving at least one of the remaining segments disposed in the storage position into the plane, that defines the active abrasive conditioning surface, without stopping conditioning the surface of a CMP pad and thereby extending the operational service life of the circular abrasive conditioning disk.

3. The method of claim 2 further including the step of independently moving the at least three abrasive segments in a direction that is approximately normal to the plane that defines the active abrasive conditioning surface.

4. The method of claim 1 further including the step of adjusting the angle of contact of the at least three segments with the plane that defines the active abrasive conditioning surface of the disk.

5. The method of claim 1 further including the step of independently moving the at least three abrasive segments in a direction that is approximately normal to the plane that defines said active abrasive conditioning surface.

6. The method of claim 1 wherein each abrasive portion of the at least three abrasive segments is wedge shaped and has a vertex that is oriented approximately toward the rotational center of circular abrasive conditioning disk.

7. The method of claim 6 wherein each of the at least three wedge shaped abrasive segments has a similar shape and substantially equal characteristic dimensions to the other wedge shaped abrasive segments.

8. The method of claim 1 wherein each abrasive segment of the at least three abrasive segments is circular in shape and has a diameter that is equal to that of the other abrasive segments.

9. The method of claim 1 wherein each abrasive segment of the at least three abrasive segments is noncircular in shape and has the same characteristic dimensions as each of the other of the plurality of noncircular abrasive segments.

10. The method of claim 1 wherein each of the at least three the independently movable noncircular abrasive segments is disposed in relation to the other noncircular abrasive portions in such a way as to comprise a radially symmetrical pattern about the rotational center of the circular abrasive conditioning disk.

11. The method of claim 1 wherein the at least three independently movable noncircular abrasive segments are disposed in relation to one another in such as way as to be radially symmetrical about the rotational center of the circular abrasive conditioning disk.

* * * * *